United States Patent [19]

Miller

[11] Patent Number: 4,573,577

[45] Date of Patent: Mar. 4, 1986

[54] STACKABLE CONTAINER

[75] Inventor: Daniel R. Miller, Cincinnati, Ohio

[73] Assignee: Buckhorn Material Handling Group Inc., Milford, Ohio

[21] Appl. No.: 119,799

[22] Filed: Feb. 8, 1980

[51] Int. Cl.[4] ..... B65D 21/06

[52] U.S. Cl. ..... 206/506

[58] Field of Search ..... 206/506

[56] References Cited

U.S. PATENT DOCUMENTS

| | | | |
|---|---|---|---|
| 2,029,746 | 4/1936 | Tufts | 206/506 |
| 2,641,383 | 6/1953 | Coursey | 206/506 |
| 3,375,953 | 4/1968 | Miller | 206/506 |
| 3,379,339 | 4/1968 | Asenbauer | 206/506 |
| 3,752,352 | 8/1973 | Senecal | 206/513 |
| 4,105,117 | 8/1978 | Atkin | 206/506 |

FOREIGN PATENT DOCUMENTS

| | | | |
|---|---|---|---|
| 1131652 | 2/1957 | France | 206/506 |

*Primary Examiner*—George E. Lowrance
*Attorney, Agent, or Firm*—Beall Law Offices

[57] ABSTRACT

A container has bails movable between three different positions for providing support of an upper container on a lower container at three different levels.

5 Claims, 15 Drawing Figures

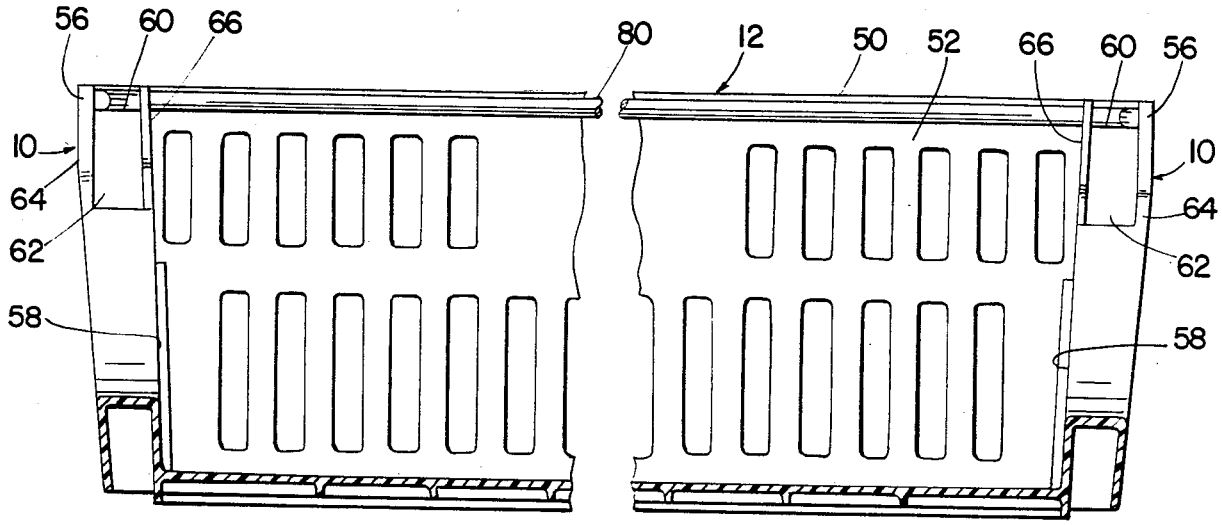
Fig. 3
Fig. 4
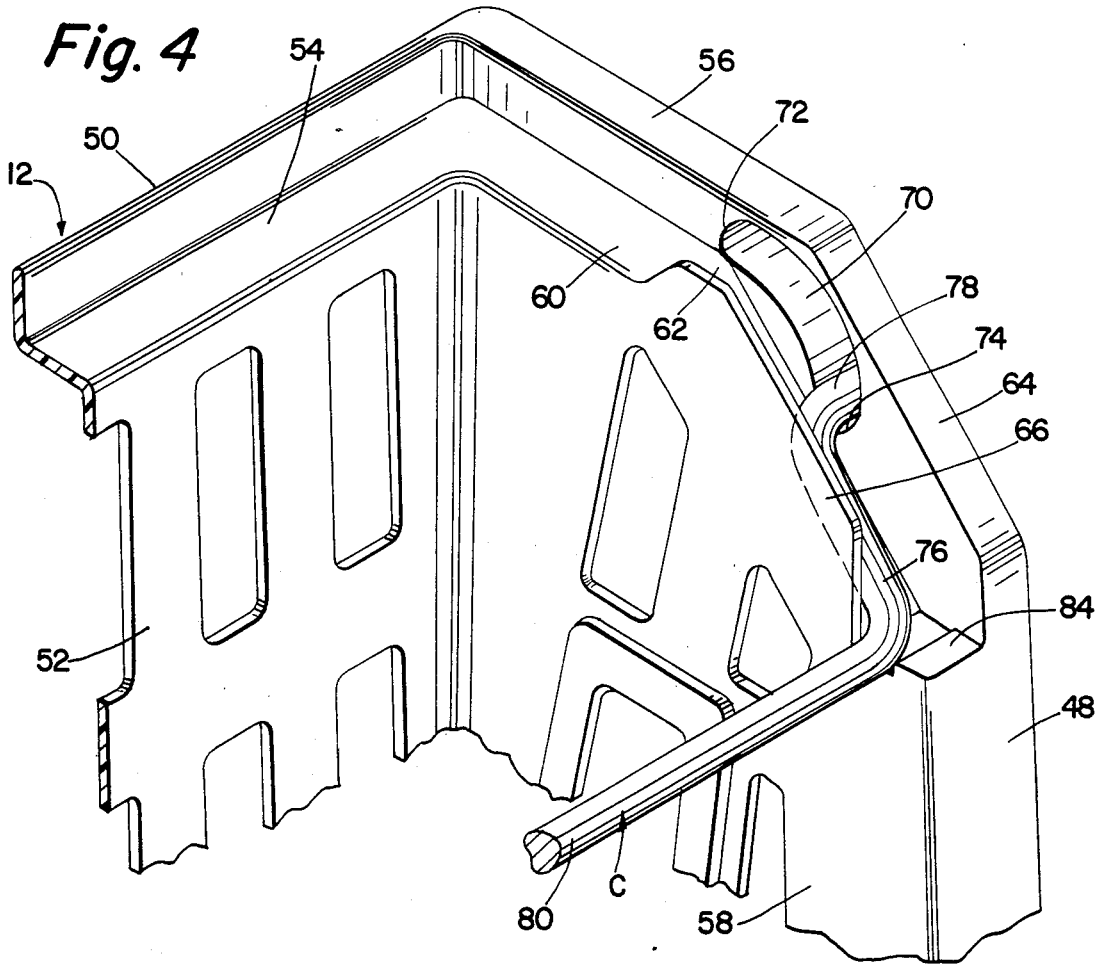

STACKABLE CONTAINER

BACKGROUND OF THE INVENTION

This application relates to the art of containers and, more particularly, to containers which are nestable and stackable with one another. The invention is particularly applicable for use with bakery trays and the like, and will be particularly described with reference thereto. However, it will be appreciated that the invention has broader aspects and may be used with containers other than bakery trays.

It is common to provide bakery trays and other containers with pivoted bails which swing between an inner container stacking position and an outer container nesting position. In their inner container stacking position, the bails support the bottom of an upper container in a stacking position on top of a lower container. This makes it possible to fill the containers with items and provide the stacking of the filled containers without smashing the contents. In their outer container nesting position, the bails allow a plurality of empty containers to be nested within one another so they occupy substantially less space during storage and return shipment.

It is also known to provide bakery trays and like containers with arrangements for stacking and nesting at more than two different levels. Bakery trays are commonly used for transporting bakery goods of different heights in a single layer. For example, bakery trays may be used for transporting loaves of bread and this requires stacking of the trays at a relatively high level on one another to prevent smashing of the bread loaves. The same trays may be used for transporting much smaller items, such as cupcakes or the like. In order to store and transport a large number of trays in a given vertical height, it is desirable to have the trays stacked within one another at a much lower level when transporting cupcakes or the like as compared to transporting bread. When the trays are empty, it is still desirable to have them nest within one another. Known arrangements for providing stacking and nesting at more than two different levels include the use of pivoted bails which provide a high stacking position and also allow nesting. Stacking at a lower level or position is accomplished by providing support columns on the sidewalls of the trays. With the bails in their outer container nesting positions, the containers will either stack at a low level on the sidewall columns or will nest by rotating the trays 180°. The necessity of rotating the containers 180° to provide either nesting or a low level stacking position is inconvenient, and it would be desirable to have a tray which could stack and nest at more than two levels simply by moving the bails to a plurality of different positions.

SUMMARY OF THE INVENTION

A container has bails selectively movable between a plurality of positions for providing support of an upper container at a plurality of different levels on a lower container.

The container includes a bottom wall having opposite end walls and opposite sidewalls upstanding therefrom. The bails are attached to the end walls adjacent the sidewalls and extend across the container top opening substantially parallel to the sidewalls. The bails are pivotally movable between the two different positions for supporting the bottom wall of an upper container at two different elevations above the bottom wall of a lower container. The bails are also movable to a third position for providing nesting of the upper container within the lower container.

The bails are mounted to the end walls in arcuate slots having upper and lower slot ends. The bails pivot between two different container stacking positions when the bails are located at the lower ends of the slots. The bails are movable to the upper ends of the slots for positioning the bails in their third position providing nesting of the containers.

It is a principal object of the present invention to provide an improved container having movable bails for providing stacking of an upper container at a plurality of different levels on a lower container.

It is a further object of the invention to provide a container having bails mounted thereto for both pivotal and sliding movement to allow selective location of the bails at three different positions.

It is an additional object of the invention to provide a container which is stackable and nestable with like containers at three different levels.

BRIEF DESCRIPTION OF THE DRAWING

FIG. 3 is a cross-sectional elevational view taken generally on line 3—3 of FIG. 1;

FIG. 4 is a partial perspective illustration showing how a bail is movably attached to a container;

DESCRIPTION OF A PREFERRED EMBODIMENT

Figure 1:
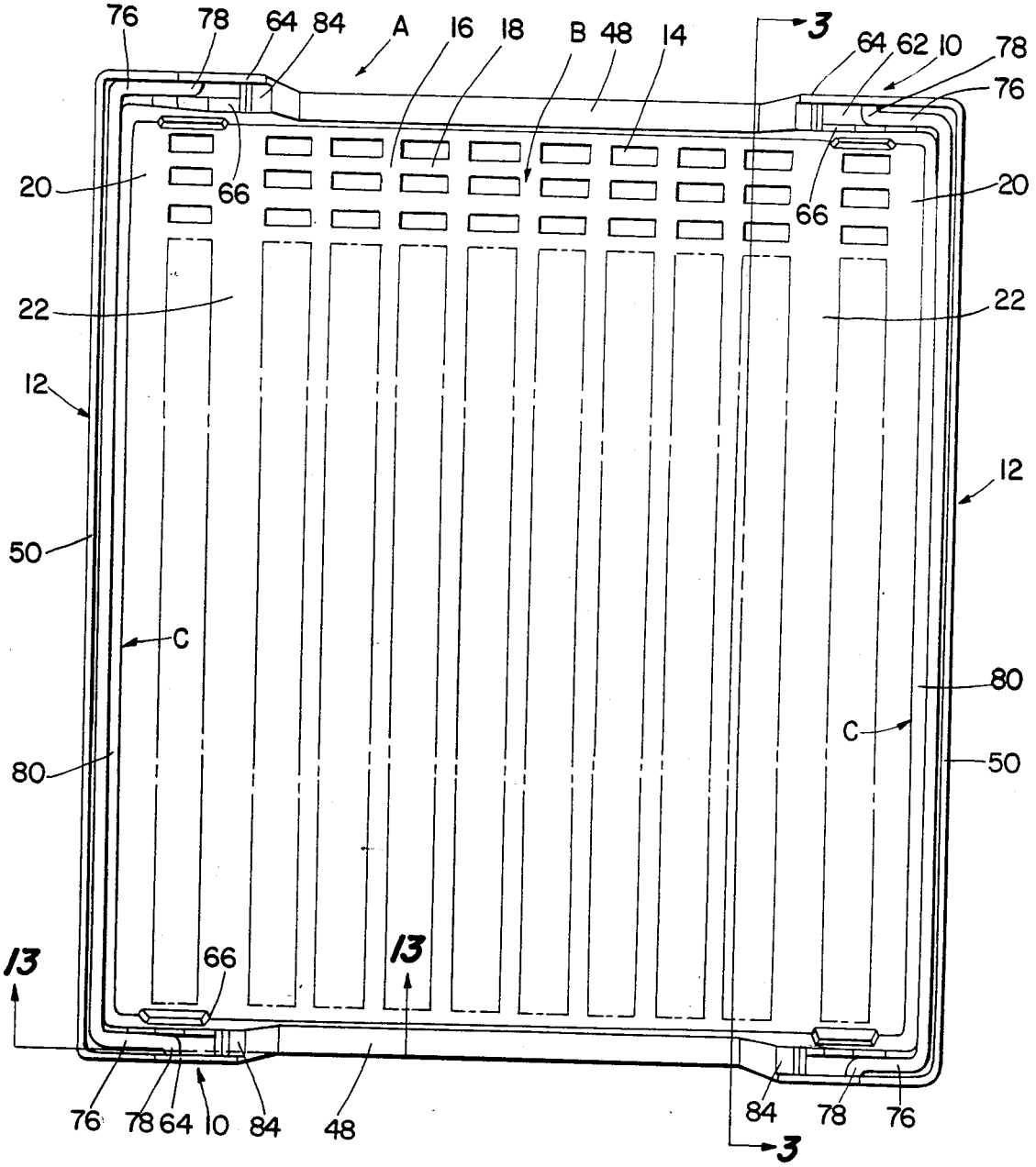
FIG. 1 is a top plan view of a container constructed in accordance with the present application.

With reference to the drawing, FIG. 1 shows a generally rectangular container A including a bottom wall B having a peripheral wall upstanding therefrom defined by a pair of opposed end walls 10 and a pair of opposed sidewalls 12. Bottom wall B is of a grid-like construction having a plurality of spaced-apart generally rectangular openings 14 therein. A plurality of spaced-apart longitudinal webs 16 extend across end walls 10 and a plurality of spaced-apart transverse webs 18 extend across side walls 12 to cooperate in defining openings 14. Outer and inner relatively wide longitudinal webs 20 and 22 are provided in bottom wall B adjacent sidewalls 12.

Figure 2:
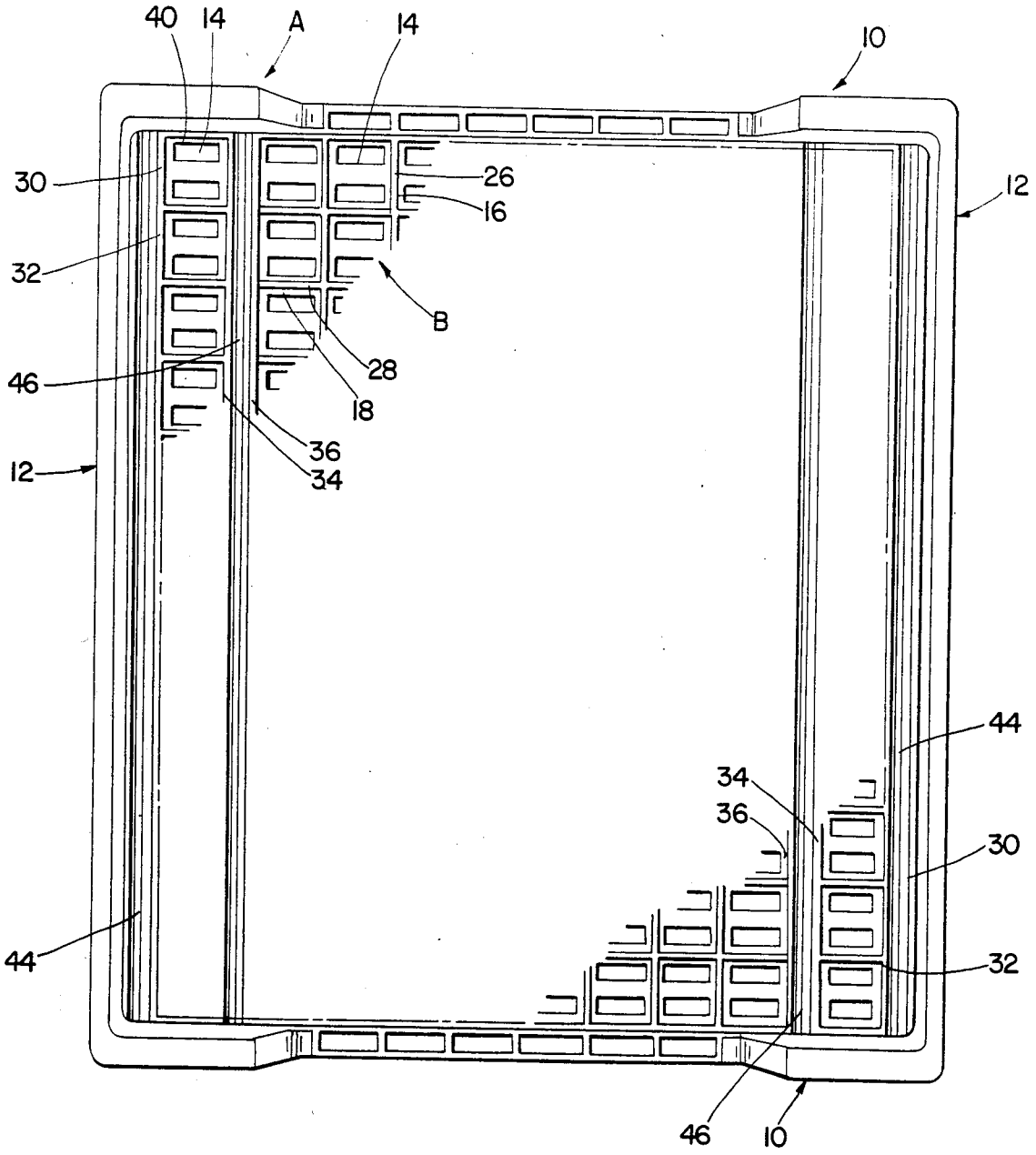
FIG. 2 is a bottom plan view thereof.

As shown in FIG. 2, the underside of bottom wall B is provided with longitudinal stiffening ribs 26 centrally located on longitudinal webs 16. Alternate transverse webs 18 are also provided with central transverse stiffening ribs 28.

Along outer wide webs 20, the underside of bottom wall B is provided with spaced-apart longitudinal flanges 30 and 32 which project outwardly therefrom a distance slightly greater than the projecting distance of longitudinal and transverse ribs 26, 28. Along inner wide webs 22, the underside of bottom wall B is provided with spaced-apart longitudinal flanges 34 and 36 extending outwardly therefrom the same distance as flanges 30, 32. Transverse ribs 40 extending between flanges 32, 34 between every other opening 14 extending between flanges 32, 34. When container A is positioned on a smooth horizontal surface, it is supported on the outer surfaces of flanges 30, 32, 34 and 36, and ribs 40, with the outer surfaces of ribs 26, 28 spaced slightly above the supporting surface.

Downwardly opening outer grooves 44 are defined between flanges 30, 32 and these outer grooves extend longitudinally parallel to sidewalls 12 closely adjacent same. Inner longitudinal grooves 46 are defined between flanges 34, 36 and extend parallel to outer grooves 44.

End walls 10 are stepped downwardly as at 48 over a major portion of the length thereof centrally between sidewalls 12 so that end walls 10 extend the full height of sidewalls 12 over only a relatively short distance adjacent to sidewalls 12. End walls 10 and sidewalls 12 are provided with a plurality of spaced-apart openings therein for decreasing the weight of the container and reducing the amount of plastic material used therein. These openings also provide air circulation and drainage of water when the containers are washed. As best shown in FIG. 3, sidewalls 12 have an upper rim portion 50 spaced outwardly from inner surface 52 thereof to define an upwardly facing generally horizontal shoulder 54. Side rim 50 extends around end walls 10 to form short end rims 56 spaced outwardly from end wall inner surfaces 58 to provide upwardly facing generally horizontal end wall shoulders 60 forming a continuation of shoulder 50. End walls 10 have upwardly facing inclined surfaces 62 extending from end wall shoulders 60. Inclined surfaces 62 are inclined downwardly in a direction away from sidewalls 12. Outer flanges 64 project upwardly on the outer sides of inclined surfaces 62, while inner flanges 66 project upwardly from inclined surfaces 62 in parallel spaced relationship to outer flanges 64. Outer flanges 64 form a continuation of end rims 56. The top opening of the container is defined by the upper edges of sidewall inner surfaces 52 and end wall inner surfaces 58.

Figure 5:
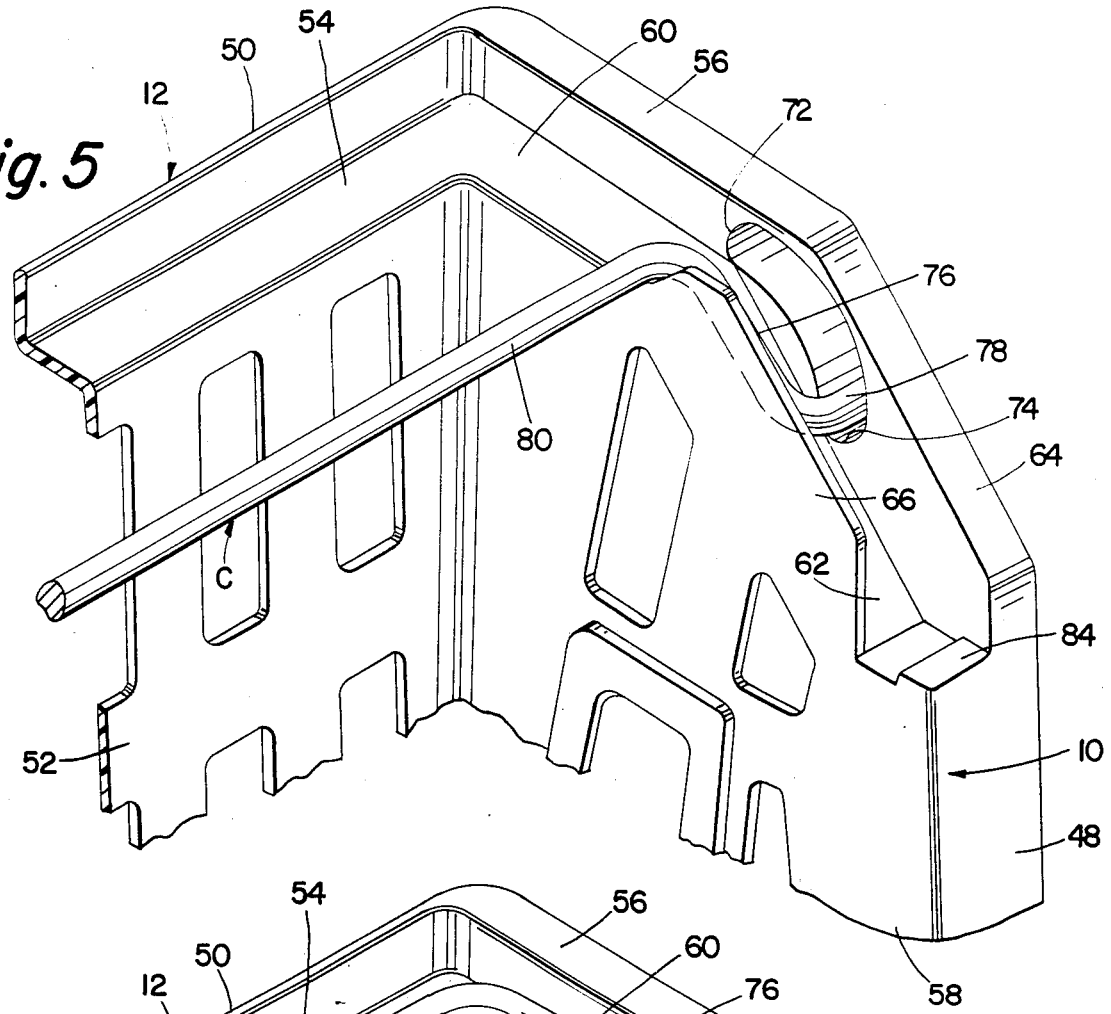
FIG. 5 is a view similar to FIG. 4 and showing a bail in another position.
Figure 6:
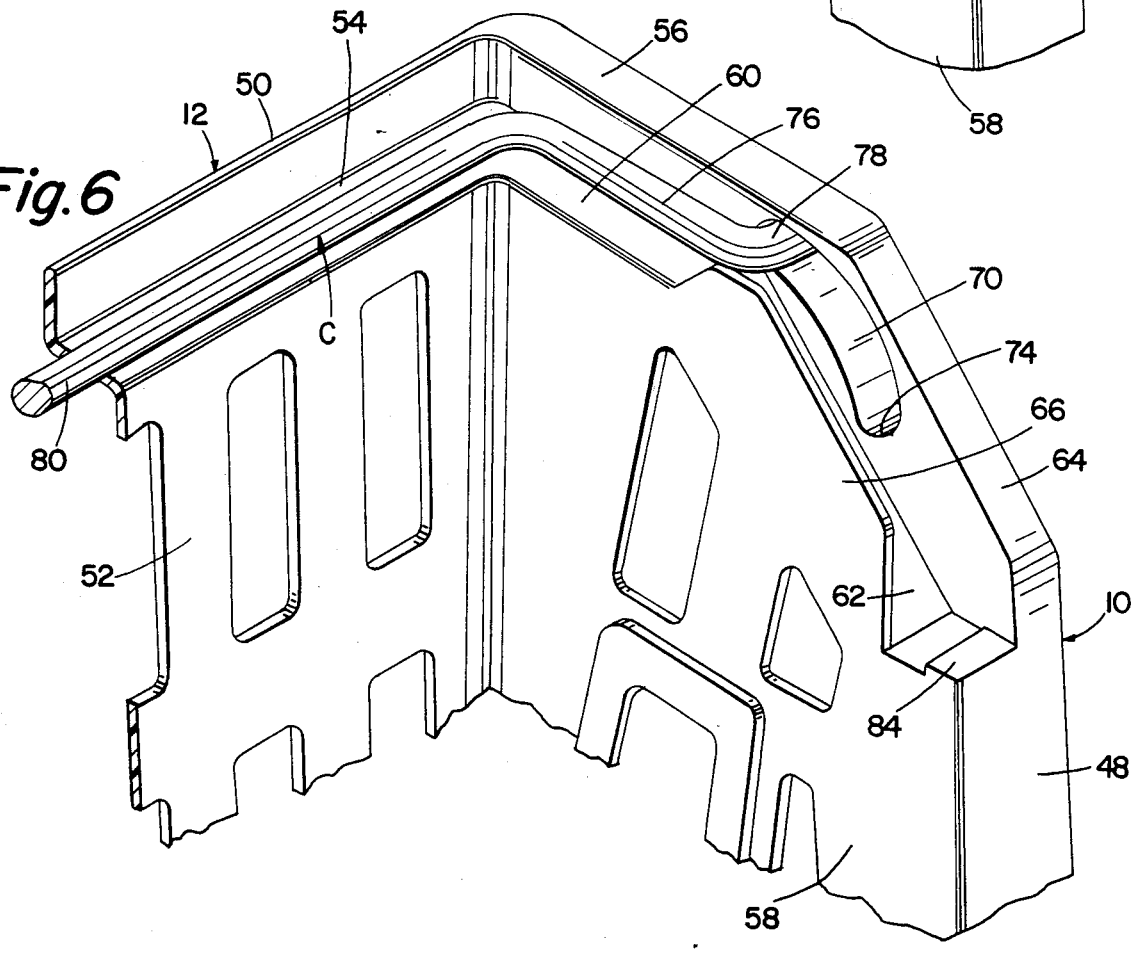
FIG. 6 is a view similar to FIGS. 4 and 5, and showing a bail in still another position.

With reference to FIGS. 4–6, inner flange 66 projects upwardly along inclined surface 62 in parallel spaced relationship to outer flange 64. Inner flange 66 extends only along outer flange 64 and does not extend in opposition to end rim 56. End walls 10 are provided with apertures therein for movably mounting bails C thereto and, in the arrangement shown, the apertures take the form of arcuate slots 70 in outer flanges 64. Slots 70 have upper slot ends 72 and lower slot ends 74. Slots 70 are curved inwardly and downwardly in a direction away from a sidewall 12. Upper slot ends 72 are located closer to sidewalls 12 and are spaced further above bottom wall B than lower slot ends 74. In other words, lower slot ends 74 are located further from sidewalls 12 and closer to bottom wall B than upper slot ends 72.

Each metal bail C is formed of a metal rod having a generally cylindrical cross-sectional configuration. Each bail C has opposite arm portions 76 extending generally along inclined surfaces 62. Bail stem portions 78 extend outwardly from one end of bail arms 76. Each bail has an elongated central bail portion 80 extending between the other ends of arms 76, and spanning the container top opening. Bail stems 78 are pivotally and slidably received in arcuate slots 70, with bail rod portion 80 being eccentric to the pivot axis of stems 78.

With bail stems 78 located at lower slot ends 74, bail arms 76 are pivotable about stems 78 to extend either downwardly along inclined support surfaces 62 as shown in FIG. 4, or to extend upwardly along inclined support surfaces 62 as shown in FIG. 5. In both of the positions of FIGS. 4 and 5, bail rod portion 80 extends across the top opening of the container defined by the inner peripheral surfaces of the end walls and sidewalls. Rod portion 80 in FIG. 4 is spaced further from sidewall 12 and positioned closer to bottom wall B than in the position of FIG. 5. In the position of FIG. 4, bail C supports an upper container at a relatively low level stacking position. In the position of FIG. 5, bail C supports an upper stacked container at a relatively high level stacking position. In both positions, the bail extends across the periphery of the top opening for the container.

From the high level stacking position of FIG. 5, bail C is movable to a third position shown in FIG. 6 by sliding bail stems 78 upwardly along slots 70 to upper slot ends 72. In this position, bail arms 76 and rod portion 80 extend along shoulders 60, 54 outwardly of the periphery of the top opening in the container. An upper container may then be nested within a lower container without any interference from bail C.

Bail means C may be considered movable between first and second positions when located at the lower ends of slots 70 as shown in FIGS. 4 and 5, and may be considered movable to a third position by sliding along slots 70 to the upper ends thereof. Bail means C may be considered in a first position in FIG. 5 and in a second position in FIG. 4, while being in a still third position in FIG. 6. In the first position of FIG. 5, bail means C is in a first relative location spaced inwardly of sidewall 12 and above bottom wall B, and in the second position of FIG. 4 is in a second relative location spaced further from sidewall 12 and closer to bottom wall B than in the first relative location of FIG. 5.

As shown in FIGS. 4–6, end walls 10 have upwardly extending abutments 84 at the bottom ends of inclined support surfaces 62 before being inclined downwardly at cut-away portions 48.

Figure 7:
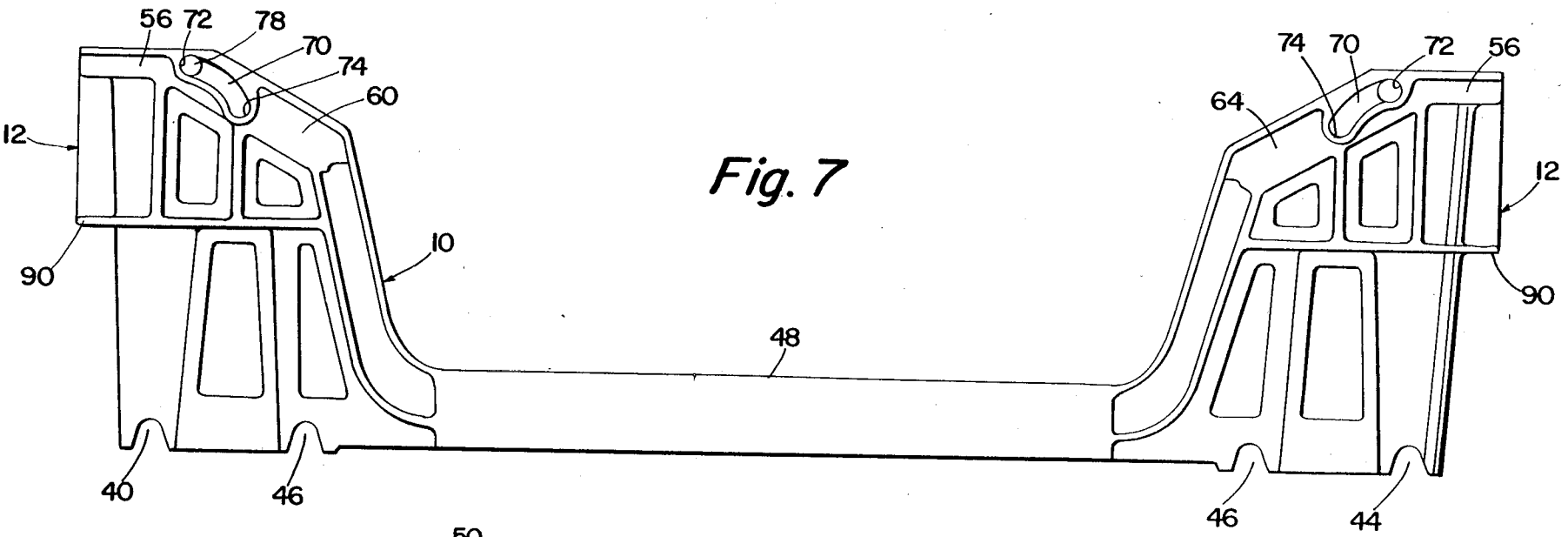
FIG. 7 is an end elevational view of the container.
Figure 8:
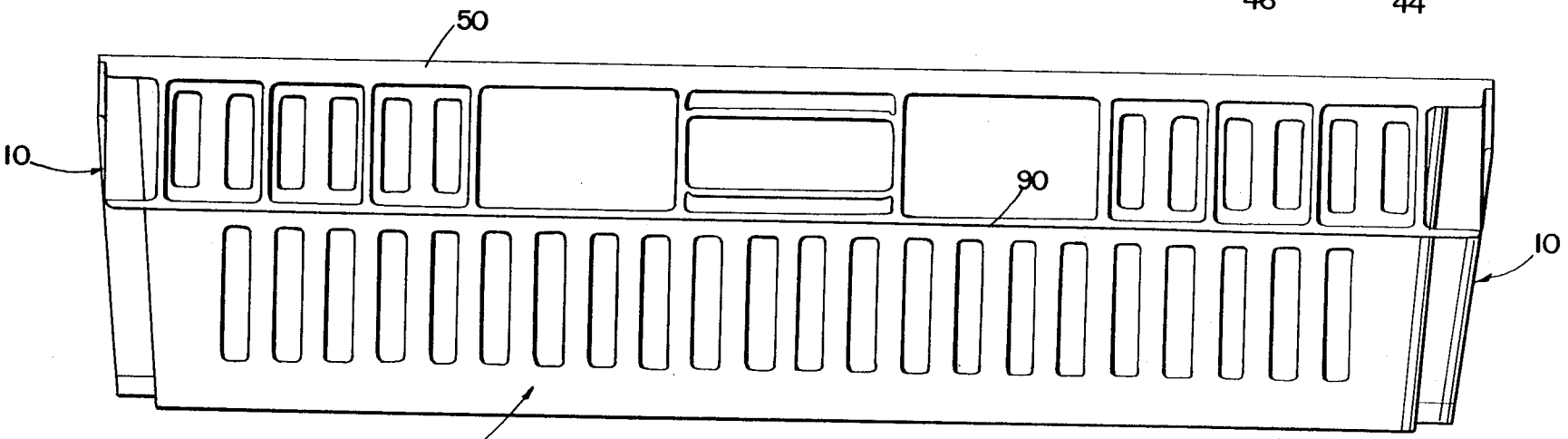
FIG. 8 is a side elevational view thereof.

End walls 10 and sidewalls 12 slope outwardly slightly as they extend up from bottom wall B. Therefore, the top opening of the container is slightly larger than the area of bottom wall B. This allows the lower portion of an upper container to nest within a lower container. As best shown in FIGS. 7 and 8, end walls 10 and sidewalls 12 have an outwardly extending support flange 90 intermediate the top edges of sidewalls 12 and the bottom edges thereof. Support flanges 90 are actually located slightly closer to the top edges of sidewalls 12 than to the bottom edges thereof. Support flanges 90 extend outwardly a sufficient distance for engaging the top edges of rims 50, 56 in FIGS. 4–6 when an upper container is nested within a lower container.

Figure 9:
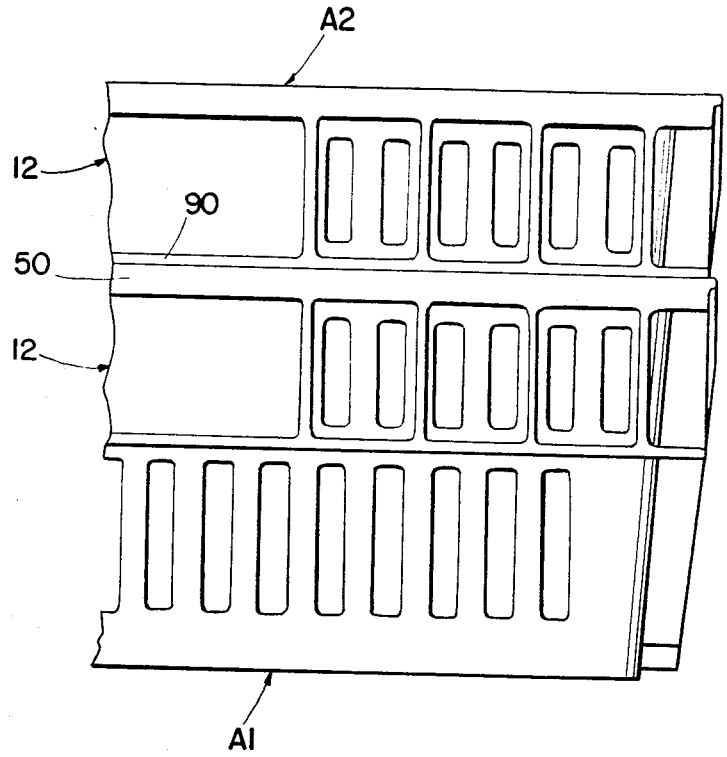
FIG. 9 is a partial side elevational view showing two nested containers.
Figure 10:
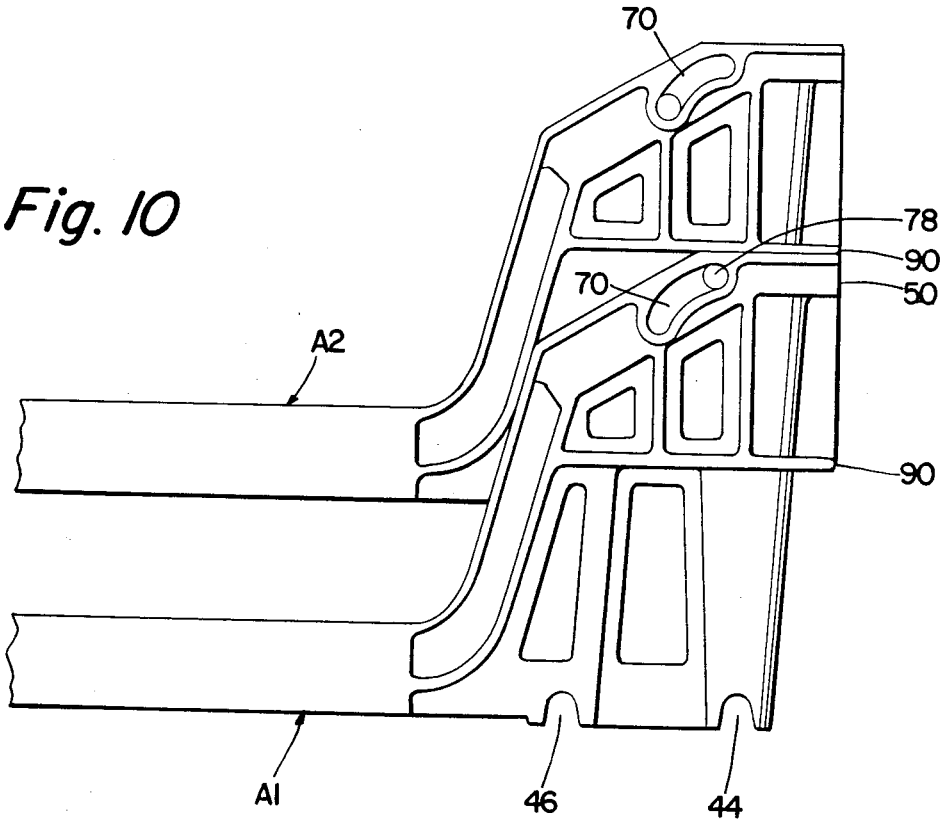
FIG. 10 is a partial end elevational view showing two nested containers.
Figure 13:
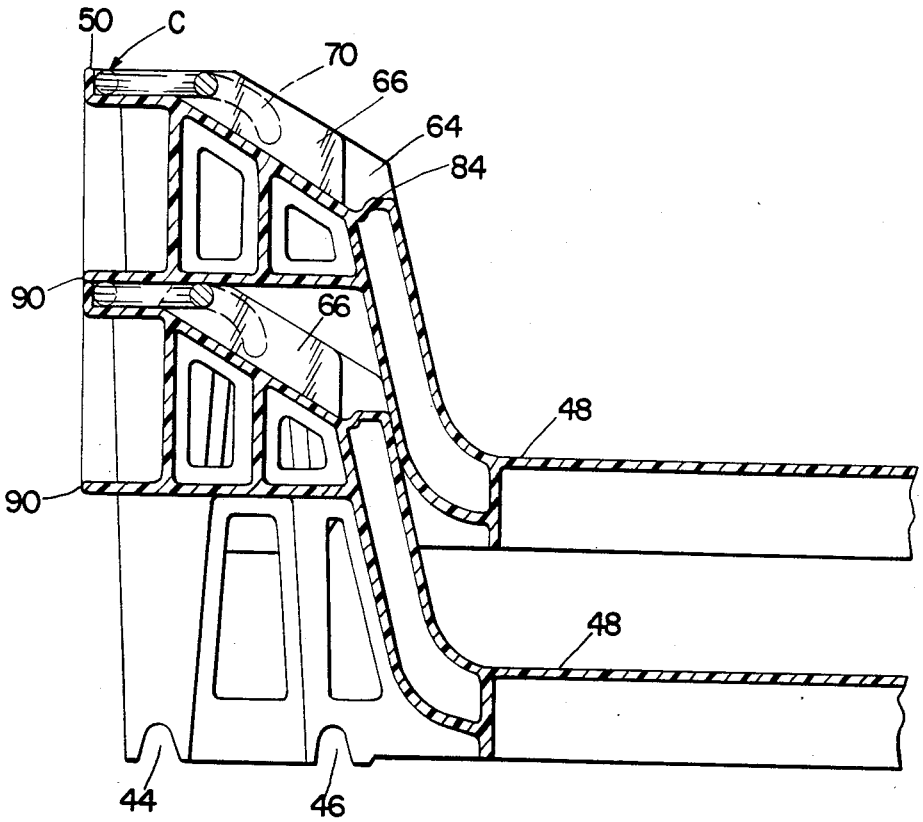
FIG. 13 is a partial cross-sectional end elevational view taken generally on line 13—13 of FIG. 1 and showing a pair of nested containers.

FIGS. 9 and 10 show an upper container A2 nested within a lower container A1. The bails on lower container A1 are in their third nesting position of FIG. 6 for allowing free nesting of upper container A2 within lower container A1. The diameter of the metal rod from which bail C is formed is less than the height of rims 50, 56 above shoulders 54, 60. Thus, support flange 90 on upper container A2 is supported on the upper surface of rim 50. In this nesting position, approximately 60% of the full height of upper container A2 is received within lower container A1. As shown in FIG. 10, the bottom walls of the two containers are spaced from one another to allow carrying of cupcakes or the like within a plurality of nested containers without smashing the cupcakes. FIG. 13 is a sectional view showing the position of two nested containers.

Figure 11:
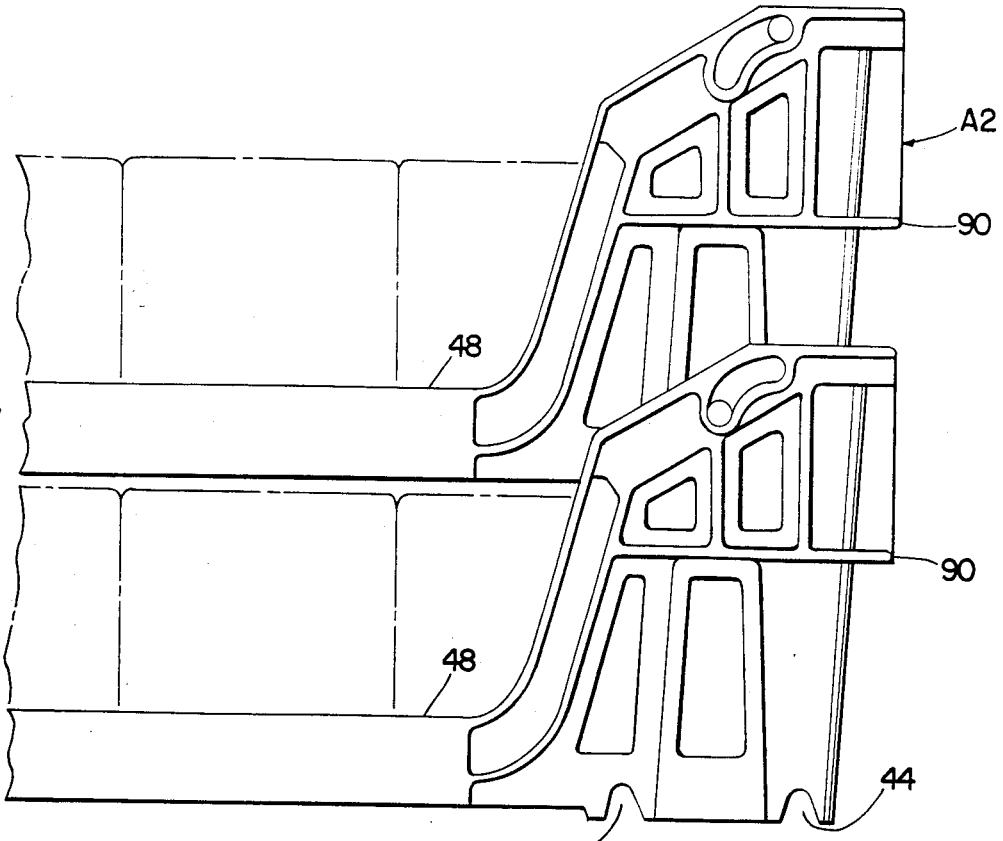
FIG. 11 is a partial end elevational view showing two containers stacked at a low level.
Figure 14:
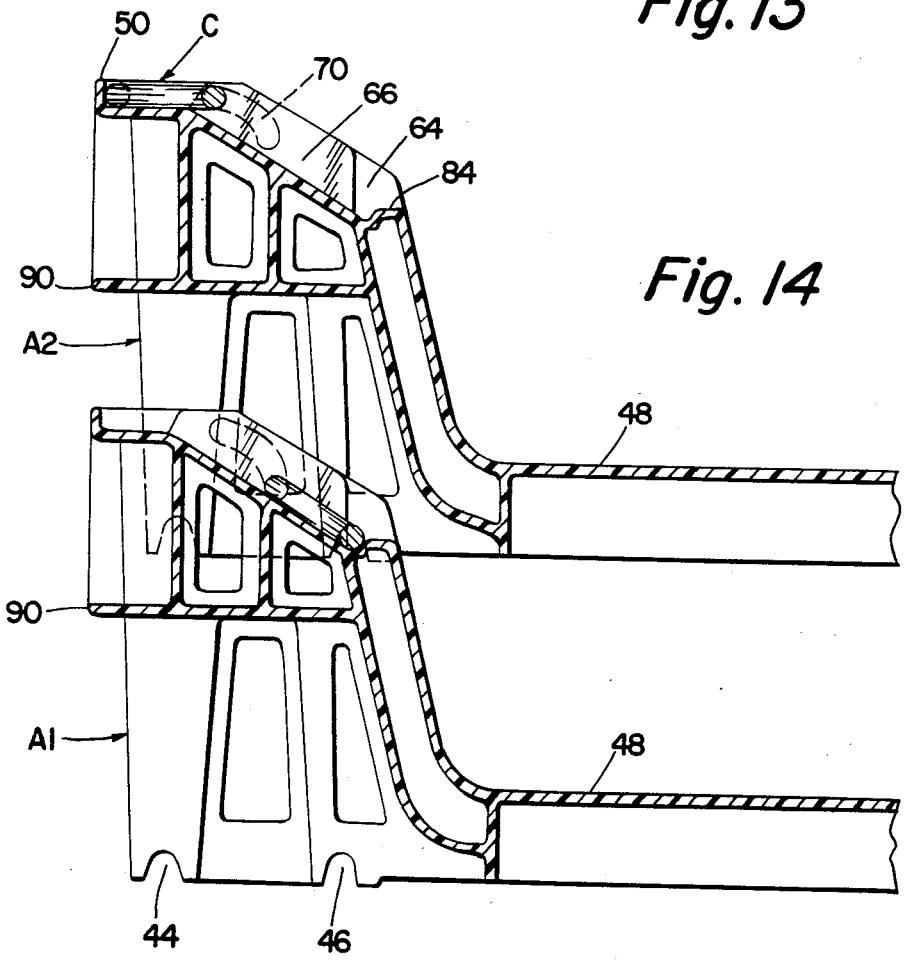
FIG. 14 is a view similar to FIG. 13 and showing a pair of containers stacked at a low level.

FIGS. 11 and 14 show a pair of containers in an intermediate level nesting position. In this position, the bails on lower container A1 are in the low level stacking position of FIG. 4. In that position, rod portions 80 of bails C are spaced-apart the same distance as downwardly facing grooves 46 on the underside of container A. Therefore, inner grooves 46 receive bail rod portions 80 for stably supporting upper container A2 in an intermediate level stacked position on lower container A1. In this position, the bottom walls of the two stacked containers are spaced further apart than in the nesting position of FIGS. 10 and 13 for supporting different goods such as buns or the like.

Figure 12:
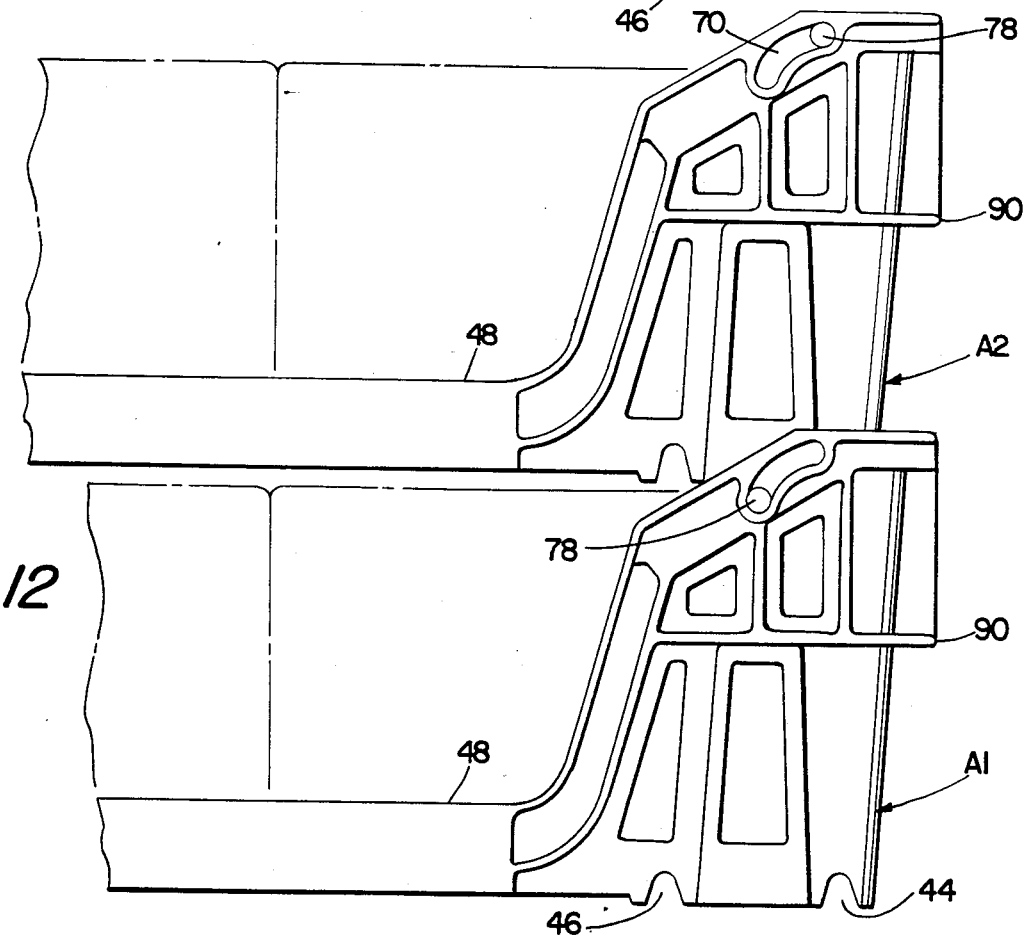
FIG. 12 is a partial end elevational view showing two containers stacked at a high level.
Figure 15:
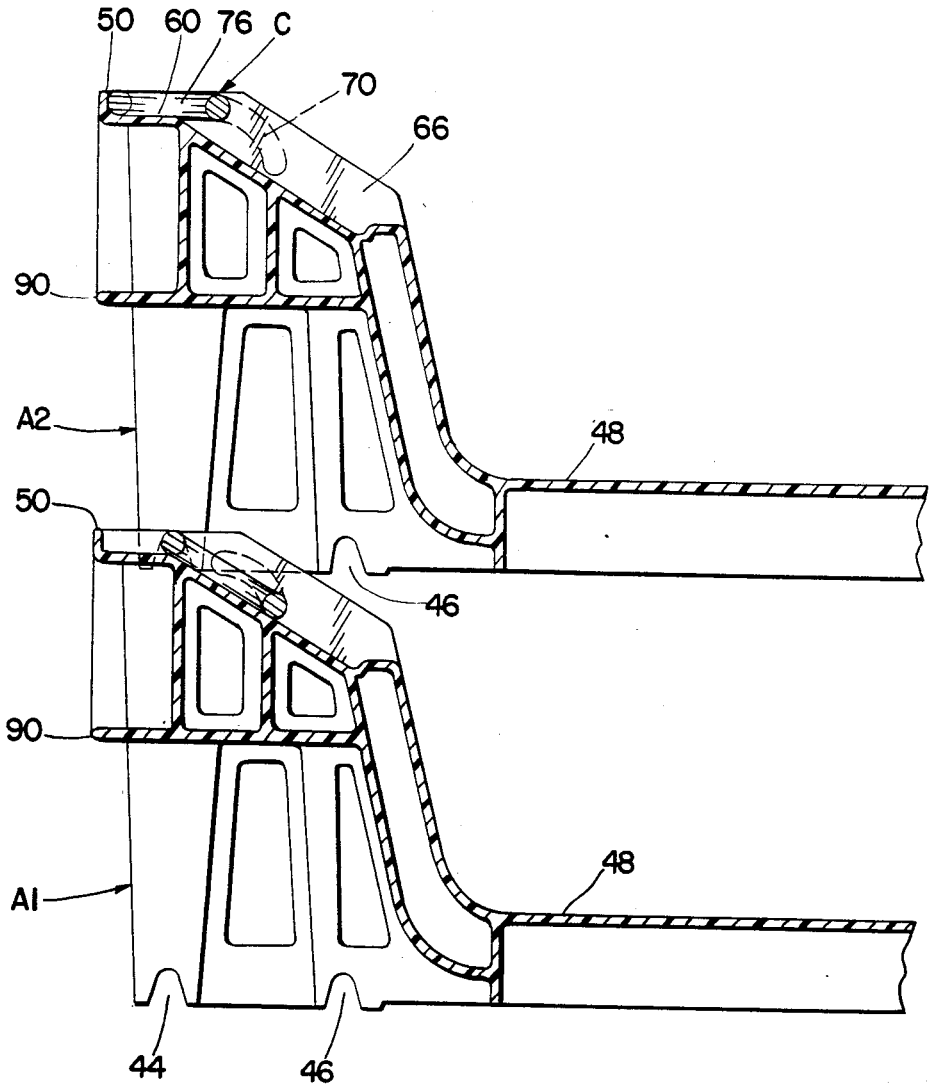
FIG. 15 is a view similar to FIG. 13 and showing a pair of containers stacked at a high level.

In the position of FIGS. 12 and 15, the bails on lower container A1 are located in the position of FIG. 5 for reception of bail rod portions 80 in outer downwardly facing grooves 44 in upper container A2 for stably supporting the upper container on the lower container. In this position, the bottoms of the two containers are spaced further from one another than in the stacking position of FIGS. 11 and 14 in order to accommodate larger articles such as loaves of bread or the like.

The containers are stackable and nestable at three different levels while being similarly oriented so there is no need to rotate an upper container 180°. Three different stacking levels are accomplished simply by pivoting or sliding the bails. The bails move between three different positions for providing support of an upper container at three different levels on a lower container. In two of the bail positions, it is the bails themselves which provide support for the upper container, while in the third bail positions, the upper container is supported directly on the lower container. In the two positions of the bails for directly supporting an upper container at two different levels, the bails extend across the lower container top opening within the periphery thereof. In the third position of the bails, they are located outside the periphery of the container top opening for providing nesting of an upper container within a lower container. Arcuate slots 70 in FIGS. 4–6 have lower slot ends 74 thereof located approximately midway between the upper and lower ends of upwardly facing inclined support surfaces 62. This allows bail arms 76 to extend downwardly along inclined support surfaces 62 in the position of FIG. 4 and to extend upwardly therealong in the position of FIG. 5. Inner flanges 66 of FIG. 3 have upper edges or surfaces located at approximately the same elevation as the upper edges or surfaces of outer flanges 64 and end wall rims 56. Therefore, inner flanges 66 provide inner guide surfaces for guiding an upper container into nesting position within a lower container. In the absence of such inner flanges, the bottom of an upper container could hang up on the bail or otherwise make it more difficult to nest an upper container within a lower container.

In the bail position of FIG. 4, the ends of rod portion 80 adjacent bail arms 76 engage against upwardly extending abutments 84 to provide additional support for bail rod portions 80 so that all of the weight of an upper container is not carried through bail stems 78 to lower slot ends 74. Likewise, in the bail positions of FIG. 5, the end portions of rod portion 80 adjacent bail arms 76 engage the upper ends of inner flanges 66 of FIG. 3 to provide additional support for the bail rods so that all of the weight of an upper container is not transmitted through the bail stems 78 to lower slot ends 74.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. An open-top container having a bottom wall, side walls extending upwardly from opposite sides of said bottom wall, end walls extending upwardly from said bottom wall between said side walls, said side walls being constructed such that said container may receive an upper container of identical construction in nested relation therewith at a low level, and stacking means associated with said container for supporting an upper container of identical construction in stacked relation thereon selectively at a high level and at an intermediate level between the high and low levels, said stacking means comprising a pair of bales, and means mounting said bales on said container for movement from a first position adapted to support an upper container of identical construction at said high level, to a second position adapted to support an upper container of identical construction at said intermediate level, and to a third position adapted to clear an upper container of identical construction for nesting at said low level, said mounting means comprising means on said end walls providing elongated slots near each end of each side wall, pins on the ends of the said bales engaging said slots, means on said end walls for supporting said bales in said first position when said pins are engaged in one end of said slots, means on said end walls for supporting said bales in said second position when said pins are engaged in said one end of said slots, and means on said side walls for supporting said bales in said third position when said pins are engaged in the opposite ends of said slots.

2. A container as defined in claim 1, said container having seat portions adapted to receive the bales of a lower container of identical construction when stacked thereon at said high and intermediate levels.

3. A container as defined in claim 2, wherein said seat portions are recesses in the underside of said container.

4. In an open-top container having a bottom wall, side walls extending upwardly from opposite sides of said bottom wall, said side walls being constructed such that said container may receive an upper container of identical construction in nested relation therewith at a low level, and stacking means associated with said container for supporting an upper container of identical construction in stacked relation thereon selectively at a high level and at an intermediate level between the high and low levels, said stacking means comprising a pair of bales, and means mounting said bales on said container for movement from a first position adapted to support an upper container of identical construction at said high level, to a second position adapted to support an upper container of identical construction at said intermediate level, and to a third position adapted to clear an upper container of identical construction for nesting at said low level, said mounting means comprising means providing elongated slots near each end of each side wall, pins on the ends of the said bales engaging said slots, means for supporting said bales in said first position when said pins are engaged in one end of said slots, means for supporting said bales in said second position when said pins are engaged in said one end of said slots, and means for supporting said bales in said third position when said pins are engaged in the opposite ends of said slots.

5. An open-top container having a bottom wall, side walls extending upwardly from opposite sides of said bottom wall, said side walls being constructed such that said container may receive an upper container of identical construction in nested relation therewith at a low level, and stacking means associated with said container for supporting an upper container of identical construction in stacked relation thereon selectively at a high level and at an intermediate level between the high and low levels, said stacking means comprising a pair of bales, and means mounting said bales on said container for movement from a first position adapted to support an upper container of identical construction at said high level, to a second position adapted to support an upper container of identical construction at said intermediate level, and to a third position adapted to clear an upper container of identical construction for nesting at said low level, said mounting means comprising means providing elongated slots near each end of each side wall, pins on the ends of the said bales engaging said slots, means for supporting said bales in one of said positions when said pins are engaged in one end of said slots, means for supporting said bales in another of said positions when said pins are engaged in said one end of said slots, and means for supporting said bales in still another of said positions when said pins are engaged in the opposite ends of said slots.

* * * * *